US011603676B2

(12) United States Patent
Genova

(10) Patent No.: US 11,603,676 B2
(45) Date of Patent: Mar. 14, 2023

(54) MOVEMENT ASSISTANCE DEVICE FOR A SPA COVER

(71) Applicant: Leisure Concepts, Inc., Spokane, WA (US)

(72) Inventor: Michael C. Genova, Spokane, WA (US)

(73) Assignee: Leisure Concepts, Inc., Spokane, WA (US)

( * ) Notice: Subject to any disclaimer, the term of this patent is extended or adjusted under 35 U.S.C. 154(b) by 80 days.

(21) Appl. No.: 17/429,448

(22) PCT Filed: Feb. 12, 2020

(86) PCT No.: PCT/US2020/017899
§ 371 (c)(1),
(2) Date: Aug. 9, 2021

(87) PCT Pub. No.: WO2020/167926
PCT Pub. Date: Aug. 20, 2020

(65) Prior Publication Data

US 2022/0120105 A1 Apr. 21, 2022

Related U.S. Application Data

(60) Provisional application No. 62/805,436, filed on Feb. 14, 2019.

(51) Int. Cl.
*E04H 4/08* (2006.01)

(52) U.S. Cl.
CPC ..... *E04H 4/084* (2013.01); *E04H 4/082* (2013.01)

(58) Field of Classification Search
CPC ..... E04H 4/084; E04H 4/082
USPC ..... 4/498
See application file for complete search history.

(56) References Cited

U.S. PATENT DOCUMENTS 9,689,472 B2 * 6/2017 Maeda ..... F16H 61/04
2007/0256229 A1 * 11/2007 Duarte ..... E04H 4/084 4/498
2010/0313352 A1 * 12/2010 Sloss ..... E04H 4/084 4/498

(Continued)

OTHER PUBLICATIONS

The International Search Report and the Written Opinion of the International Searching Authority, PCT/US20/17899, dated May 7, 2020.

*Primary Examiner* — Huyen D Le
(74) *Attorney, Agent, or Firm* — Randall Danskin P.S.

(57) ABSTRACT

A movement assistance device for a spa cover having at least two spa cover portions each spa cover portion having opposing lateral peripheral edges, hinge and end peripheral edges and wherein the spa cover portions are movable one relative to the other from a first coplanar orientation to a second, stacked orientation, and a biasing pneumatic cylinder which cooperates with and extends between a first bracket secured to one lateral peripheral edge of one spa cover portion and a hinge bracket secured to the same lateral peripheral edge of the same spa cover portion adjacent the hinge peripheral edge and the hinge bracket is further secured to an aligned lateral peripheral edge of a second spa cover portion and adjacent to the hinge peripheral edge thereof, and wherein the pneumatic cylinder assists and controls the movement one spa cover portion relative to the other spa cover portion.

16 Claims, 8 Drawing Sheets

(56) References Cited

U.S. PATENT DOCUMENTS

2015/0174410 A1* 6/2015 Mika ..... A61N 1/36578
607/9

* cited by examiner

MOVEMENT ASSISTANCE DEVICE FOR A SPA COVER

TECHNICAL FIELD

The present invention relates to a movement assistance device for a spa cover, and more specifically to a device which is operable to permit a user to conveniently and easily move portions of a spa cover, one relative to the other and relative to a spa, in a manner not possible heretofore.

BACKGROUND OF THE INVENTION

Covers for spas, also commonly known as "hot tubs" have been utilized for decades. These spa covers are often employed in cooler climates to minimize the escape of heat energy from the spa. Further they are often employed to cover the spa to prevent unauthorized access to the spa, or to prevent debris such as dirt, leaves, insects and the like from being deposited within, and collecting within, the spa. Heretofore, spa covers have had two portions which have been usually fabricated from lightweight, insulative sheets, and which have been typically enclosed in a flexible, synthetic, fluid impermeable sheet or envelope. The two portions are typically joined together by a hinge that may be, or may not be, continuous so that the cover portions are movable, one relative to the other. In many prior art spa covers the hinge is formed by a seam of flexible, typically fluid impermeable, material which bridges between the two halves or portions.

It has been a common practice to remove such prior art spa covers by swinging or moving one-half of the spa cover onto the remaining other half, and then lifting, or sliding, both of the halves off of the top of the spa in order to expose the spa opening for use. As is described in detail in many prior art references, this task of removing the spa cover has sometimes been difficult because of the awkwardness of the spa cover construction, and further due to the weight of these spa covers as the same spa covers may have become heavier, over time, due to the absorption of water which is occasioned by their proximity to the underlying heated spa water, or because water is absorbed from the ambient environment.

In my U.S. patent application Ser. No. 14/526,825 which was filed on Oct. 29, 2014, I describe a rigid spa cover which has individual portions which are operable to fold onto themselves and then be removed separately from the underlying spa so as to assist in the opening of the spa. This particular spa cover design represents an improvement over my spa cover as seen in U.S. Pat. No. 8,813,275, and which was issued on Aug. 26, 2014. This spa cover has achieved a great deal of commercial success, and experienced widespread market acceptance because the construction substantially prevents the absorption of water into the interior of the spa cover portions, and further this design permits a user to stand on the spa cover in order to remove accumulations of snow, leaves and other debris that might be occasioned by the use of the spa during the fall and winter seasons, or when the spa is installed in a position such that the cover is only accessible from one edge/side.

While the aforementioned spa cover designs which I have commercially introduced have achieved a great deal of commercial success, users of spas who have various medical conditions, or otherwise have reduced strength, still find some difficulty in removing the aforementioned spa covers to expose the spa for use under certain environmental conditions such as when the spa is covered with moderate amounts of snow or other conditions, such as, high winds exist.

A movement assistance device is described in the present patent application, and which aids and assists in the movement of a spa cover to uncover a spa opening in a particularly easy, and novel manner which is not shown or described in the prior art teachings. The movement assistance device as described, and claimed is easy and simple to use, and further allows users, even with reduced strength, to readily move/remove a spa cover in a convenient and safe manner which was not possible, heretofore.

SUMMARY OF THE INVENTION

A first aspect of the present invention relates to a movement assistance device for a spa cover having two spa cover portions, and wherein the two spa cover portions are movable one relative to the other between a first position wherein the two spa cover portions are adjacent and coplanar to one another, and a second position wherein a first spa cover portion is stacked on top of a second spa cover portion, the movement assistance device comprising a hinge bracket having a first hinge portion and a second hinge portion, the first hinge portion is interconnected to a first lateral peripheral edge of the first spa cover portion adjacent a hinge peripheral edge, the first hinge portion having an axle hub defining an axle hole that is axially aligned with the hinge peripheral edge of the first spa cover portion, and the second hinge portion is interconnected to a first lateral peripheral edge of the second spa cover portion adjacent a hinge peripheral edge, the second hinge portion having an axle hub defining an axle hole that is aligned with the hinge peripheral edge of the second spa cover portion, and the second hinge portion carries a pneumatic cylinder ball that extends laterally outwardly from the second hinge portion, and a pivot axle extending simultaneously through the axle hole defined in the first hinge portion axle hub and the axle hole defined in the second hinge portion axle hub; a pneumatic cylinder ball carried by, and extending laterally outwardly from, the first lateral peripheral edge of the first spa cover portion, and spaced apart from the first hinge portion, and the pneumatic cylinder ball is coplanar with the pneumatic cylinder ball carried by the second hinge portion; and a biasing pneumatic cylinder having one end portion interconnected with the pneumatic cylinder ball carried by the first spa cover portion and having a second end portion interconnected with the pneumatic cylinder ball carried by the second hinge portion.

A second aspect of the present invention relates to a movement assistance device for a spa cover and further comprising a first bracket secured to the first lateral peripheral edge of the first spa cover portion, the first bracket carrying the pneumatic cylinder ball.

A third aspect of the present invention relates to a movement assistance device for a spa cover and further comprising a first bracket secured to the first lateral peripheral edge of the first spa cover portion, the first bracket having a horizontally extending leg, and a vertically extending leg, and the vertically extending leg carries the pneumatic cylinder ball.

A fourth aspect of the present invention relates to a movement assistance device for a spa cover and further comprising a ball mount arm carried by the second hinge portion at a bottom edge portion thereof, and the ball mount arm carries the pneumatic cylinder ball.

A fifth aspect of the present invention relates to a movement assistance device for a spa cover and wherein, the first spa cover portion, when the first spa cover portion is in the second position, is inverted relative to the second spa cover portion.

A sixth aspect of the present invention relates to a movement assistance device for a spa cover having a first spa cover portion and a second spa cover portion, each of the first and second spa cover portions having opposing spaced apart lateral peripheral edges, and a hinge peripheral edge and an opposing spaced apart end peripheral edge, and wherein the first and second spa cover portions are movable, one relative to the other, between a first position wherein the first and second spa cover portions are adjacent and coplanar to one another and wherein the hinge peripheral edge of the first spa cover portion is immediately adjacent the hinge peripheral edge of the second spa cover portion, and a second position wherein the first spa cover portion is pivoted about its hinge edge so as to be inverted and stacked on top of the second spa cover portion, the movement assistance device comprising: a first bracket secured to a first lateral peripheral edge of the first spa cover portion spacedly between the hinge peripheral edge and the end peripheral edge, the first bracket having a horizontally extending leg and an interconnected vertically extending leg, and the vertically extending leg carries a pneumatic cylinder ball extending outwardly from the vertically extending leg; a hinge bracket having a first hinge portion and a second hinge portion, the first hinge portion has an axle hub defining an axle hole and the first hinge portion is interconnected to the first lateral peripheral edge of the first spa cover portion adjacent the hinge peripheral edge of the first spa cover portion so that the axle hole defined in the axle hub is aligned with the hinge peripheral edge of the first spa cover portion, and the second hinge portion has an axle hub defining an axle hole, and the second hinge portion is interconnected to a first lateral peripheral edge of the second spa cover portion adjacent a hinge peripheral edge of a second spa cover portion, so that the axle hole defined in the axle hub is aligned with the hinge peripheral edge of the second spa cover portion, and the second hinge portion further has a pneumatic cylinder ball mount that carries a pneumatic cylinder ball that is coplanar with the pneumatic cylinder ball carried by the first bracket, and a pivot axle extending simultaneously through the axle hole defined in the first hinge portion axle hub and the axle hole defined in the second hinge portion axle hub to interconnect the first hinge portion to the second hinge portion; and a pneumatic cylinder that is interconnected with both the pneumatic cylinder ball carried by the first bracket and the pneumatic cylinder ball carried by the pneumatic cylinder ball mount of the second hinge portion.

A seventh aspect of the present invention relates to a movement assistance device for a spa cover wherein the horizontally extending leg and the vertically extending leg of the first bracket each have a forward edge, a rearward edge, an exterior surface, an interior surface and side flanges carried by the forward and rearward edges of the vertically extending leg communicate with the horizontally extending leg to provide rigidity to the first bracket and to offset the vertically extending leg laterally outwardly from the first lateral peripheral edge of the first spa cover portion, and the first bracket defines plural spacedly arrayed fastener holes for fasteners to interconnect the first bracket to the first lateral peripheral edge of the first spa cover portion An eighth aspect of the present invention relates to a movement assistance device for a spa cover wherein, the first hinge portion of the hinge bracket has a horizontally extending top portion and a vertically side extending portion, a hinge edge and an end edge, and the axle hub is proximate the hinge edge, and the first hinge portion further defines plural spacedly arrayed fastener holes for fasteners to secure the first hinge portion to the first lateral peripheral edge of the first spa cover portion.

A ninth aspect of the present invention relates to a movement assistance device for a spa cover wherein, the second hinge portion of the hinge bracket has a horizontally extending top portion, a vertically extending side portion, a hinge edge adjacent the axle hub, an end edge, and the ball mount arm, and the second hinge portion defines plural spacedly arrayed fastener holes in the horizontally extending portion top and the vertically extending side portion for fasteners to secure the second hinge portion to the first lateral peripheral edge of the second spa cover portion; and the ball mount arm extends downwardly, outwardly, and forwardly toward the hinge edge of the second hinge portion.

A tenth aspect of the present invention relates to a movement assistance device for a spa cover and further comprising a handle extending laterally outwardly from the second hinge portion.

An eleventh aspect of the present invention relates to a movement assistance device for a spa cover and further comprising a handle extending laterally outwardly from an outwardly facing surface of the ball mount arm, spacedly adjacent the pneumatic cylinder ball carried by the second hinge portion.

A twelfth aspect of the present invention relates to a movement assistance device for a spa cover wherein the pneumatic cylinder cooperates with both the first and second portions of the spa cover through the first bracket and through the hinge bracket to assist in the movement of the first spa cover portion from a first position wherein the first spa cover portion is adjacent and coplanar relative to the second spa cover portion, and in which first position the spa cover portions generally fully occlude a spa opening, to a second position wherein the first and second spa cover portions are located in a partially occluding position relative to the spa opening, and wherein the pneumatic cylinder further assists in the return of the first spa cover portion back to the adjacent and coplanar orientation relative to the second spa cover portion which fully occludes the spa opening.

A thirteenth aspect of the present invention relates to a movement assistance device for a spa cover having at least two spa cover portions, each spa cover portion having opposing lateral peripheral edges and opposing hinge and end peripheral edges, and wherein the at least two spa cover portions are movable relative to one another and relative to a spa, from a first position wherein the at least two spa cover portions are adjacent and coplanar to one another and wherein the hinge peripheral edge of a first spa cover portion is immediately adjacent the hinge peripheral edge portion of the second spa cover portion, and a second position wherein one spa cover portion is pivoted about the adjacent hinge edge portions so as to be stacked on top of the second spa cover portion, the movement assistance device comprising a first bracket secured to a first lateral peripheral edge of the first spa cover portion spacedly between the hinge peripheral edge and the end peripheral edge, the first bracket having a horizontally extending leg and a vertically extending leg each leg having a forward edge, a rearward edge, an exterior surface and an interior surface with a side flanges carried by the forward and rearward edges of the vertically extending leg and communicating with the horizontally extending leg to provide rigidity to the first bracket and to offset the vertically extending leg laterally outwardly from the first lateral peripheral edge of the first spa cover portion, the first bracket further defining a plurality of spacedly arrayed fastener holes for fasteners to interconnect the first bracket to the first lateral peripheral edge of the first spa cover portion, and the vertically extending leg carries a pneumatic cylinder ball extending generally perpendicularly outwardly from the exterior surface of the vertically extending leg: a hinge bracket having a first hinge portion and a second hinge portion, the first hinge portion having a horizontally extending top portion, a vertically extending side portion, a hinge edge, an end edge, and an axle hub adjacent the hinge edge, the first hinge portion further defining a plurality of spacedly arrayed fastener holes for fasteners to secure the first hinge portion to the first lateral peripheral edge of the first spa cover portion adjacent the hinge peripheral edge of the first spa cover portion so that an axle hole defined in the axle hub is generally axially aligned with the hinge peripheral edge of the first spa cover portion, and the second hinge portion has a horizontally extending top portion, a vertically extending side portion, a hinge edge proximate an axle hub, an end edge, and a ball mount arm, and the second hinge portion defines a plurality of spacedly arrayed fastener holes in the horizontally extending portion and the vertically extending portion for fasteners to secure the second hinge portion to a first lateral peripheral edge of the second spa cover portion adjacent the hinge peripheral edge of a second spa cover portion so that an axle hole defined in the axle hub is generally axially aligned with the hinge peripheral edge of the second spa cover portion, and the ball mount arm is structurally interconnected to a bottom edge portion of the vertically extending side portion of the second hinge portion opposite the horizontally extending top portion and the ball mount arm extends downwardly, horizontally outwardly, and toward the hinge edge the second hinge portion, the ball mount arm carrying a perpendicularly outwardly extending pneumatic cylinder ball and a handle on an outwardly facing surface and the outwardly facing surface is coplanar with the outwardly facing surface of the first bracket, and a pivot axle extending simultaneously through the axle hole defined in the first hinge portion axle hub and defined in the second hinge portion axle hub so as to interconnect the first hinge portion axle hub to the second hinge portion axle hub so that the first hinge portion is pivotally movable relative to the second hinge portion; and a pneumatic cylinder which extends between and is pivotally interconnected with the pneumatic cylinder ball carried by the first bracket and the pneumatic cylinder ball carried by the ball mount arm of the hinge bracket second hinge portion and the pneumatic cylinder mechanically cooperates with both portions of the spa cover through the first bracket and the hinge bracket to assist in the movement of the first spa cover portion from a first position coplanar orientation relative to the second spa cover portion, which occludes a spa opening, to a second position wherein the first and second spa cover portions are located in a partially occluding position relative to the spa opening, and wherein the pneumatic cylinder further assists in the return of the first spa cover portion back to the coplanar orientation relative to the second spa cover portion which occludes the spa opening.

These and other aspects of the present invention will be discussed in greater detail hereafter.

BRIEF DESCRIPTIONS OF THE DRAWINGS

FIG. 1 is a side and top perspective view of the instant invention showing the hinge bracket installed on aligned first lateral peripheral edges of a first and second spa cover portion and aligned with the cover hinge, both spa cover portions in a first adjacent and coplanar relationship for substantially fully covering a spa opening, and showing the pneumatic cylinder interconnected with the pneumatic cylinder ball carried by the hinge bracket second hinge portion, and the pneumatic cylinder ball carried by the first bracket secured to the first lateral peripheral edge of the first spa cover portion.

Figure 7:
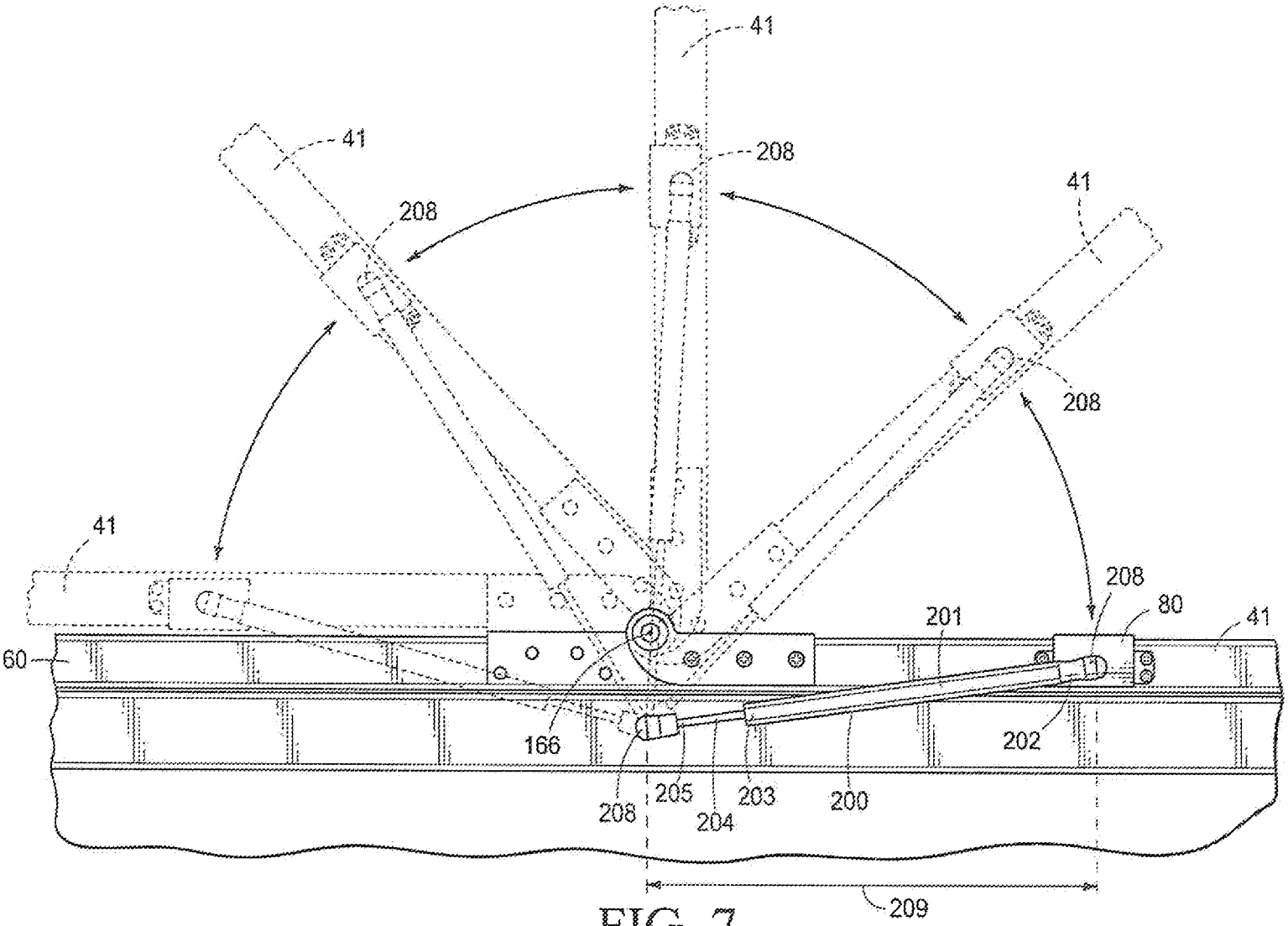

FIG. 7 is an orthographic side view of the instant invention showing the hinge bracket and the first bracket interconnected to the first lateral peripheral side portions of the first spa cover portion, and the second spa cover portion, with the pneumatic cylinder extending therebetween, and showing the first spa cover portion being pivoted (in dashed outline) relative to the second spa cover portion, from a first coplanar position to the second stacked position, and from the second stacked position to the first coplanar position.

Figure 8:
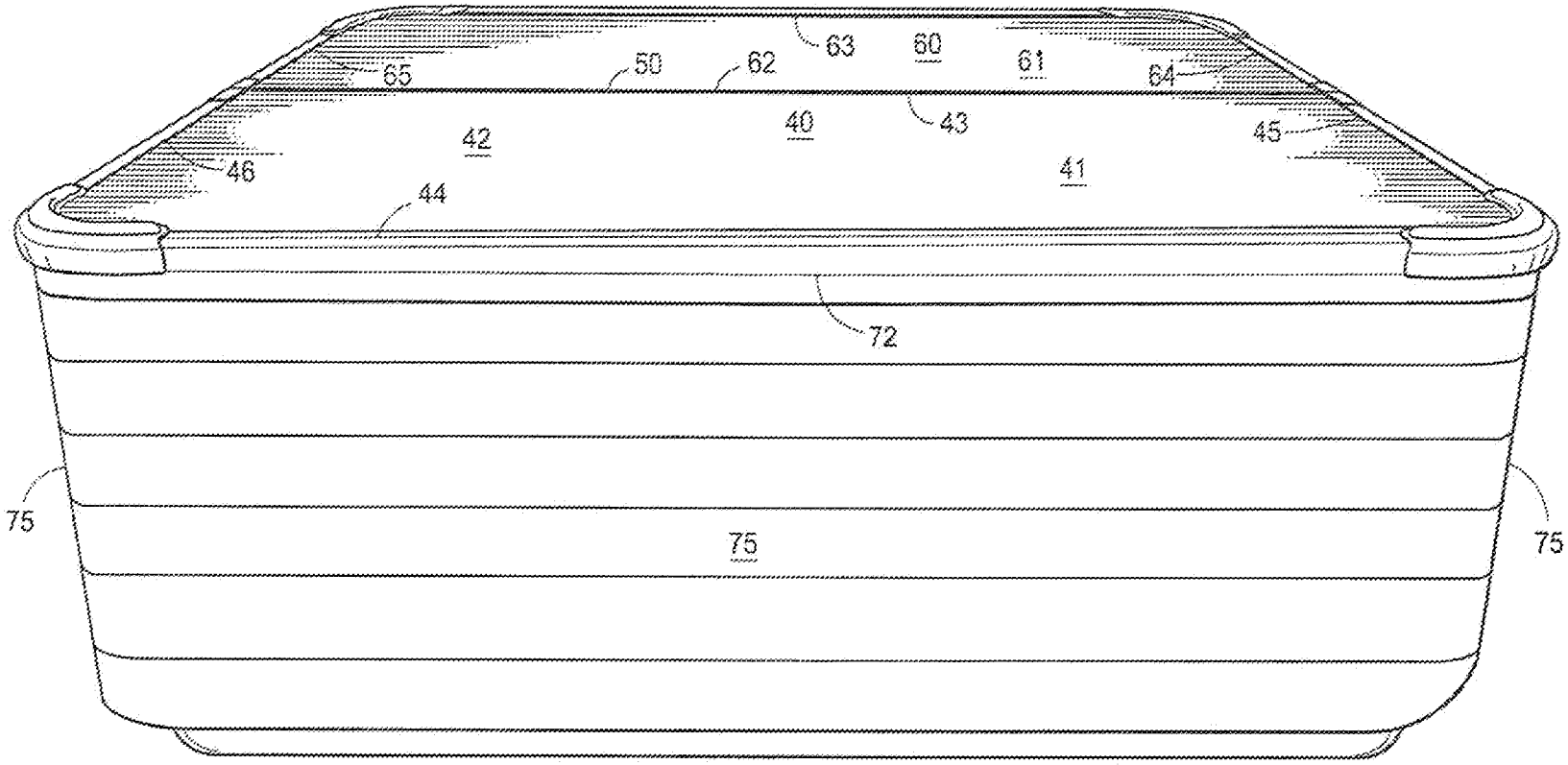

FIG. 8 is a perspective top and end perspective view of a spa cover, the type of which the instant invention may be used, showing the spa cover in a first adjacent and coplanar orientation fully occluding a spa opening, and showing a spa body with opposing generally vertical rigid sides and opposing generally vertical rigid ends.

DETAILED DESCRIPTION OF THE PREFERRED EMBODIMENT

The present invention as seen in the Figures, and which is further indicated by the numeral 10, addresses the problems associated with users who might find it difficult to remove a spa cover either because of reduced strength, or because of the location of the spa, or because of ambient environmental conditions such as snow and the like resting on the spa cover 40.

A movement assistance device for a spa cover 40 is generally indicated by the numeral 10. The spa cover 40 as seen in FIG. 8 is similar in construction to what is seen in U.S. Pat. No. 8,813,275 although the instant invention is equally applicable to other types of spa covers including covers that are not "rigid". In this regard, the spa cover 40 has a first cover portion 41 which is defined by a main body 42, and which further is defined by a hinge peripheral edge 43; an end peripheral edge 44; and first and second lateral peripheral edges 45 and 46, respectively, and which are referred to, hereinafter, as the opposite peripheral edges. The hinge peripheral edge 43 is fastened to a hinge or joint 50 which may extend substantially along the entire length of the hinge peripheral edge 43. The hinge 50, without limitation, may be a flexible seam of cover material, or may be a mechanical hinge, such as, but not limited to, a pin hinge which may be continuous (extending entirely between the opposing peripheral edges) or may be partial (not extending entirely between the opposing peripheral edges).

The second cover portion of the spa cover 40, and which relates to the present invention, is generally indicated by the numeral 60, and is further connected to the hinge 50 thereby rendering the first cover portion 41 at least partially, rotatably moveable relative to the second cover portion 60. The second portion has a main body 61 which is defined by a hinge peripheral edge 62 which is connected to the hinge 50, and an opposite end peripheral edge 63. Like the first cover portion 41, the second cover portion 60 has first and second laterally disposed peripheral edges 64 and 65. The peripheral edges 64 and 65 will hereinafter be referred to in the specification as being the opposite peripheral edges. The first and second cover portions 41 and 60, respectively, are sized so that when the individual cover portions 41 and 60 are disposed in a substantially co-planar orientation (a first position), the surface area of first and second cover portions 41, 60 is large enough to substantially fully occlude, or cover, an underlying spa opening as will be discussed in the paragraphs which follow.

It is to be understood that the instant invention 10 is intended to be installed in pairs so that one movement assistance device is interconnected to each of the first and second lateral peripheral edges of the spa cover 40. Because the instant movement assistance device 10 on both lateral peripheral edges is the same, only one invention 10 will be described in detail herein.

The instant invention 10 generally provides a first bracket 80, a hinge bracket 120, and a biasing pneumatic cylinder 200.

Figure 2:
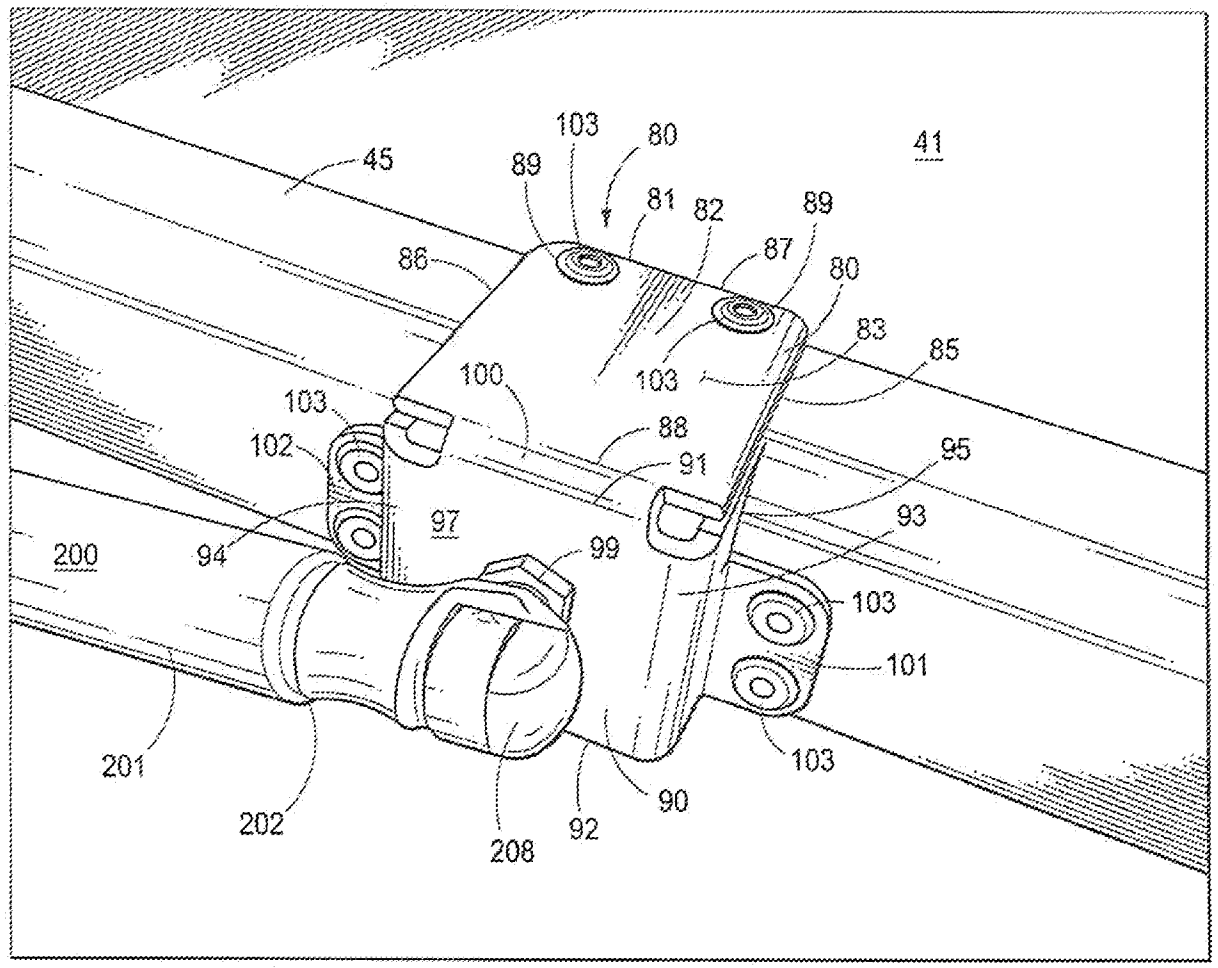
FIG. 2 is a close-up view of the first bracket of Photograph 1, showing the details thereof.
Figure 3:
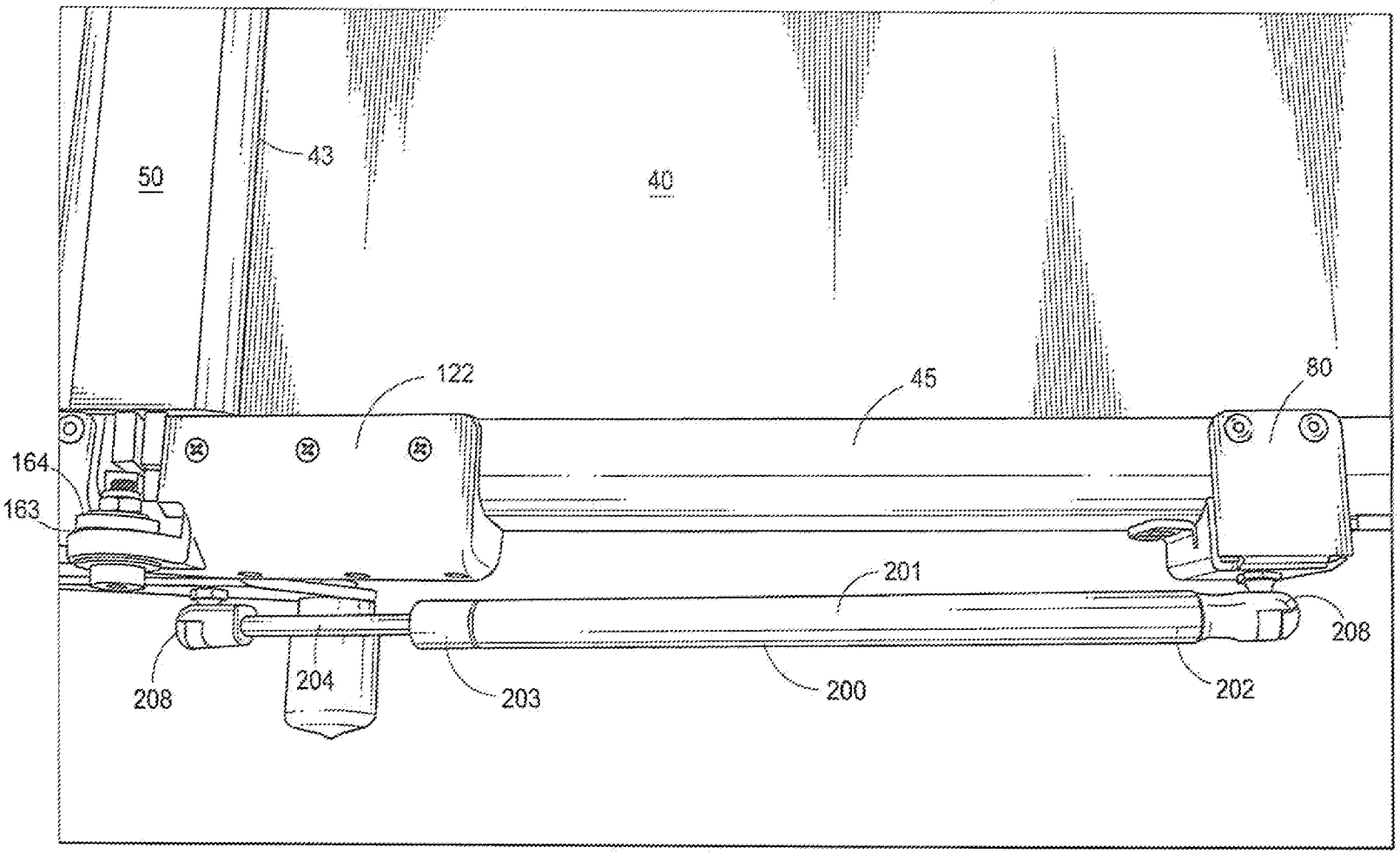
FIG. 3 is a top downwardly view of the invention shown in FIG. 1.
Figure 4:
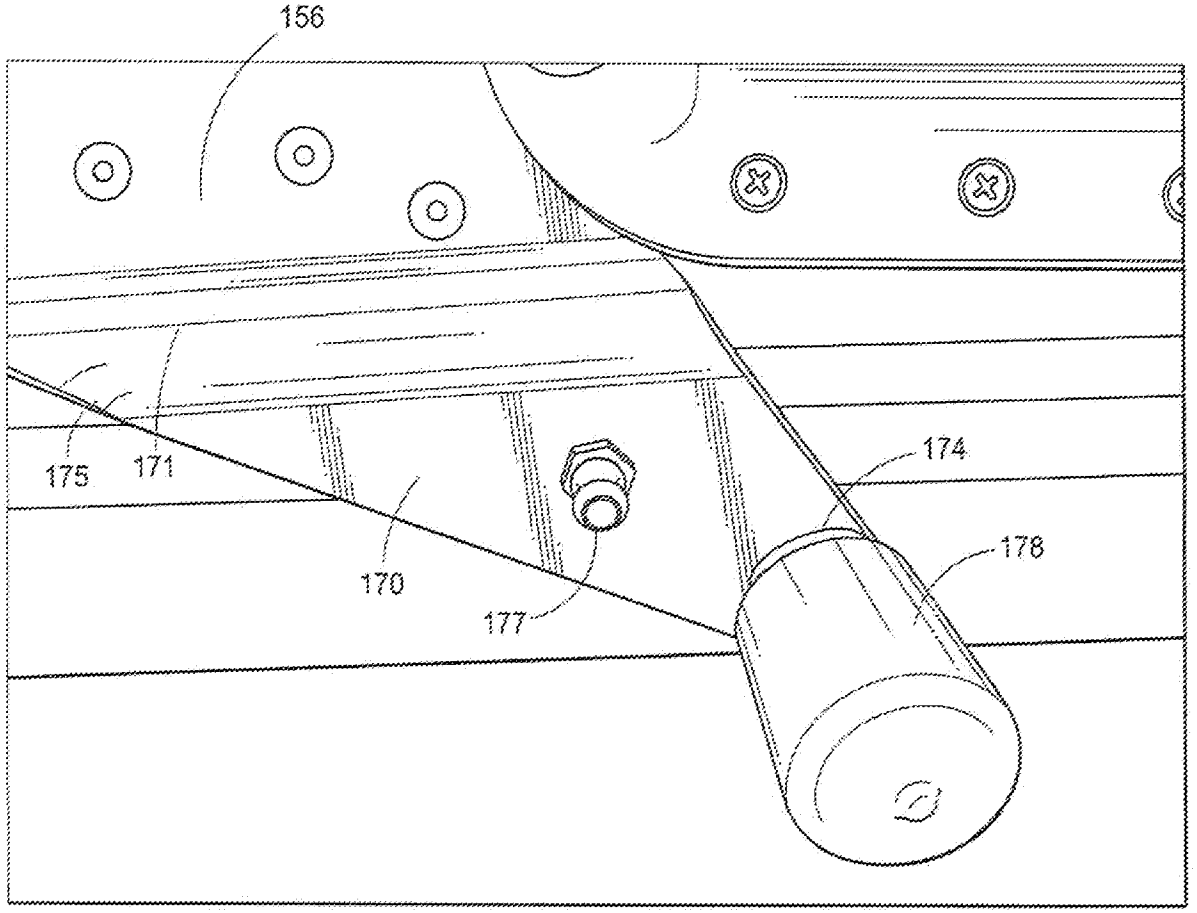
FIG. 4 is a close-up top and side perspective view of the ball mount arm of the second hinge portion showing the outwardly offsetting leg, the pneumatic cylinder ball mount and a cylindrically shaped handle.

The first bracket 80 (FIG. 2) is secured to the first lateral peripheral edge 45 of the first spa cover portion 41 spacedly between the hinge peripheral edge 43 and the end peripheral edge 44. The first bracket 80 has a main body 81 with a horizontally extending leg 82 and a vertically extending leg 90. The horizontally extending leg 82 has a top exterior surface 83, a bottom interior surface (not shown), a forward edge 85, a rearward edge 86, a laterally inner edge 87 and a laterally outer edge 88. Plural spacedly arrayed fastener holes 89 are defined in the horizontally extending leg 82 to carry fasteners 103 therein.

The vertically extending leg 90 has a top edge 91, a bottom edge 92, a forward edge 93, a rearward edge 94, an exterior facing surface 97 and an interior facing surface (not shown). The laterally outer edge 88 of the horizontally extending leg 82 is structurally interconnected with the top edge 91 of the vertically extending leg 90 forming a corner/bend 100 therebetween so that the horizontally extending leg 82 and the vertically extending leg 90 are integral with one another. Forward and rearward edge flanges 95, 96 are structurally carried on the forward edge 93 and a rearward edge 94 of the vertically extending leg 90 and extend laterally inwardly therefrom, toward the adjacent first lateral peripheral edge 45 of the spa cover first portion 41. The forward and rearward edge flanges 95, 96 provide rigidity to the first bracket 80 and also carry fastener tabs 101, 102 that extend forwardly and rearwardly from inner peripheral edges of the flanges 95, 96. The fastener tabs 101, 102 define fastener holes for fasteners 103 to secure the first bracket 80 to the first lateral peripheral edge 45 of the first portion 41 of the spa cover 40. The forward and rearward edge flanges 95, 96 also laterally offset the exterior facing surface 97 of the vertically extending leg 90 laterally outwardly from the first lateral peripheral edge 45 of the first spa cover portion 41. A pneumatic cylinder ball 99 is carried by the vertically extending leg 90 and extends generally perpendicularly laterally outwardly from the exterior facing surface 97.

Figure 5:
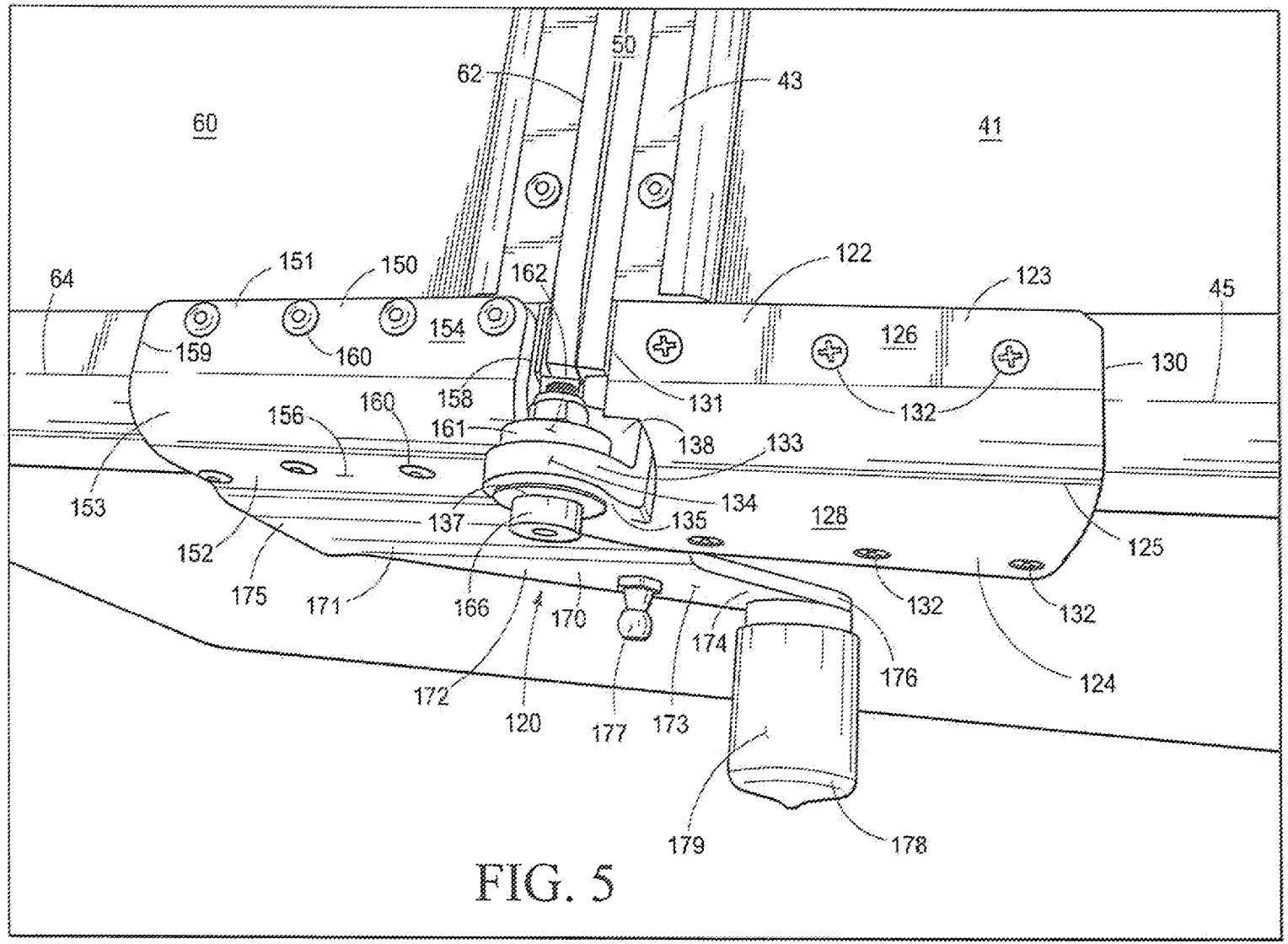
FIG. 5 is a close-up top and side downwardly looking perspective view of the hinge bracket of FIG. 1 showing the adjacent cover portion lateral peripheral edge portions, the axle hubs aligned with the cover hinge edge, the pneumatic cylinder ball mount and the handle.
Figure 6:
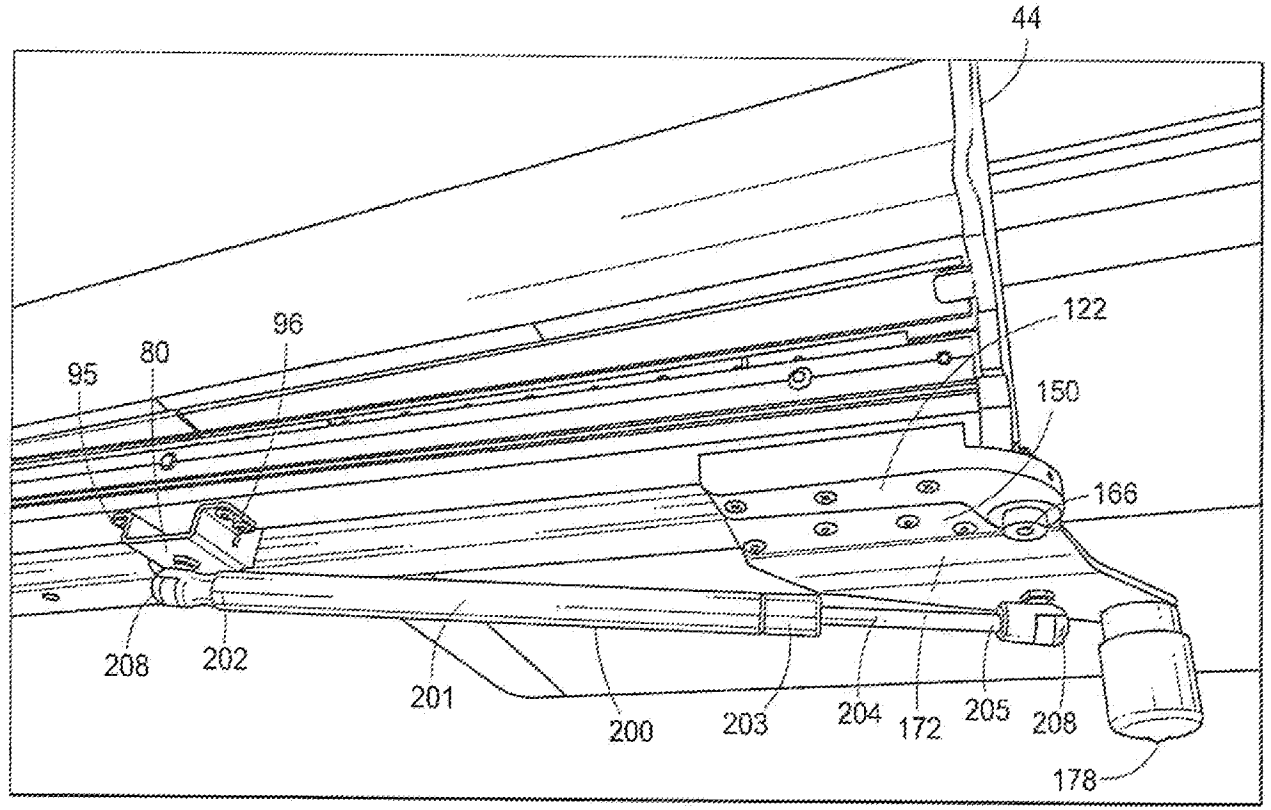
FIG. 6 is a bottom perspective view of the pneumatic cylinder, the first bracket and the hinge bracket showing the orientation of the interconnected components when the first spa cover portion is pivoted completely into a second open position relative to the second spa cover portion to at least partially uncover the spa opening.

The hinge bracket 120 (FIG. 5) has a first hinge portion 122, and a second hinge portion 150.

The first hinge portion 122 has a horizontally extending top portion 123 and a vertically extending side portion 124 with a bend 125 structurally interconnecting the horizontally extending top portion 123 and the vertically extending side portion 124. The horizontally extending top portion 123 has a top surface 126 and an opposing bottom surface (not shown). The vertically extending side portion 124 has a laterally outer surface 128 and a laterally inner surface (not shown) that is positioned immediately adjacent the first lateral peripheral edge 45 of the first spa cover portion 41. The first hinge portion 122 further has an end edge 130 and a hinge edge 131. Plural spacedly arrayed fastener holes 132 are defined in the horizontally extending top portion 123 and the vertically extending side portion 124 to carry fasteners (which may be, without limitation, screws, rivets, bolts, adhesives) to secure the first hinge portion to the first lateral peripheral edge 45 of the first spa cover portion 41 proximate the hinge peripheral edge 43.

An axle hub 133 is structurally carried by the first hinge portion 122 at the hinge edge 131. The axle hub 133 defines a circumferentially extending outer peripheral surface 134, a laterally outer surface 135 and a laterally inner surface (not shown). The axle hub 133 further defines an axle hole 137 that is generally centrally located in the axle hub 133 and extends transversely through the axle hub 133. A clearance notch 138 is defined in the horizontally extending top portion 123 of the first hinge portion 122 at the hinge edge 131 and adjacent to the laterally inner surface (not shown) of the axle hub 133. As shown in the Figures, the clearance notch 138 permits the first hinge portion 122 to fully pivot relative to the second hinge portion 150 between the first and second positions without interference (see FIG. 7). The first hinge portion 122 is fixedly secured to the first lateral peripheral edge 45 of the first spa cover portion 41 at a position wherein the axle hole 137 defined in the axle hub 133 is generally axially aligned with the hinge peripheral edge 43 of the first spa cover portion 41 and axially aligned with the hinge 50.

The second hinge portion 150, of the hinge bracket 120, has a horizontally extending top portion 151, a vertically extending side portion 152 with a bend 153 therebetween forming a structural interconnection between the horizontally extending top portion 151 and the vertically extending side portion 152. The horizontally extending top portion 151 has a top surface 154 and an opposing bottom surface (not shown). The vertically extending side portion 152 has a laterally outer surface 156 and an opposing laterally inner surface (not shown) that is positioned immediately adjacent the first lateral peripheral edge 64 of the second spa cover portion 60. The second hinge portion 150 further has a hinge edge 158 an end edge 159. Plural spacedly arrayed fastener holes 160 are defined in the horizontally extending top portion 151 and the vertically extending side portion 152 to carry fasteners to secure the second hinge portion to the first lateral peripheral edge 64 of the second spa cover portion 60.

An axle hub 161 is carried by the second hinge portion 150 at the hinge edge 158. The axle hub 161 defines a circumferentially extending outer peripheral surface 162, a laterally outer surface 163 and a laterally inner surface 164. The axle hub 161 defines a centrally located axle hole (not shown) that extends transversely through the axle hub 161. The second hinge portion 150 is fixedly secured to the first lateral peripheral edge 64 of the second spa cover portion 60 at a position wherein the axle hole 165 defined in the axle hub 161 is generally axially aligned with the hinge peripheral edge 62 of the second spa cover portion 60 and axially aligned with the continuous hinge 50.

A ball mount arm 170 is structurally carried by the second hinge portion 150 at a bottom edge of the vertically extending side portion 152. The ball mount arm 170 has an outwardly offsetting bend 171 that causes the ball mount arm 170 to extend generally horizontally laterally outwardly from the vertically extending side portion 152. A vertical flange 172 is integral with a laterally outer edge portion of the outwardly offsetting bend 171. The vertical flange 172 has a laterally outer surface 173, a first forward edge 174 defining a flange tip 176, and an opposing second rearward edge 175. A pneumatic cylinder ball 177 is carried on the exterior facing surface 173 of the vertical flange 172 between the first forward edge 174 and the second rearward edge 175. The pneumatic cylinder ball 177 extends generally perpendicularly laterally outwardly from the laterally outer surface 173 of the flange 172. As can be seen in FIG. 7, the pivot axle 166 and the pneumatic cylinder ball 177 are generally vertically aligned with one another so that axial forces exerted by the biasing pneumatic cylinder 200 are equal on both sides of vertical as the first spa cover portion 41 is pivoted about the axle 166 relative to the second spa cover portion 61.

The laterally outer surface 173 of the flange 172 is coplanar with the exterior surface 97 of the vertically extending leg 90 of the first bracket 80 so that the pneumatic cylinder ball 177 carried by the second hinge portion 150 and the pneumatic cylinder ball 99 carried by the first bracket 80 are coplanar.

Figure 1:
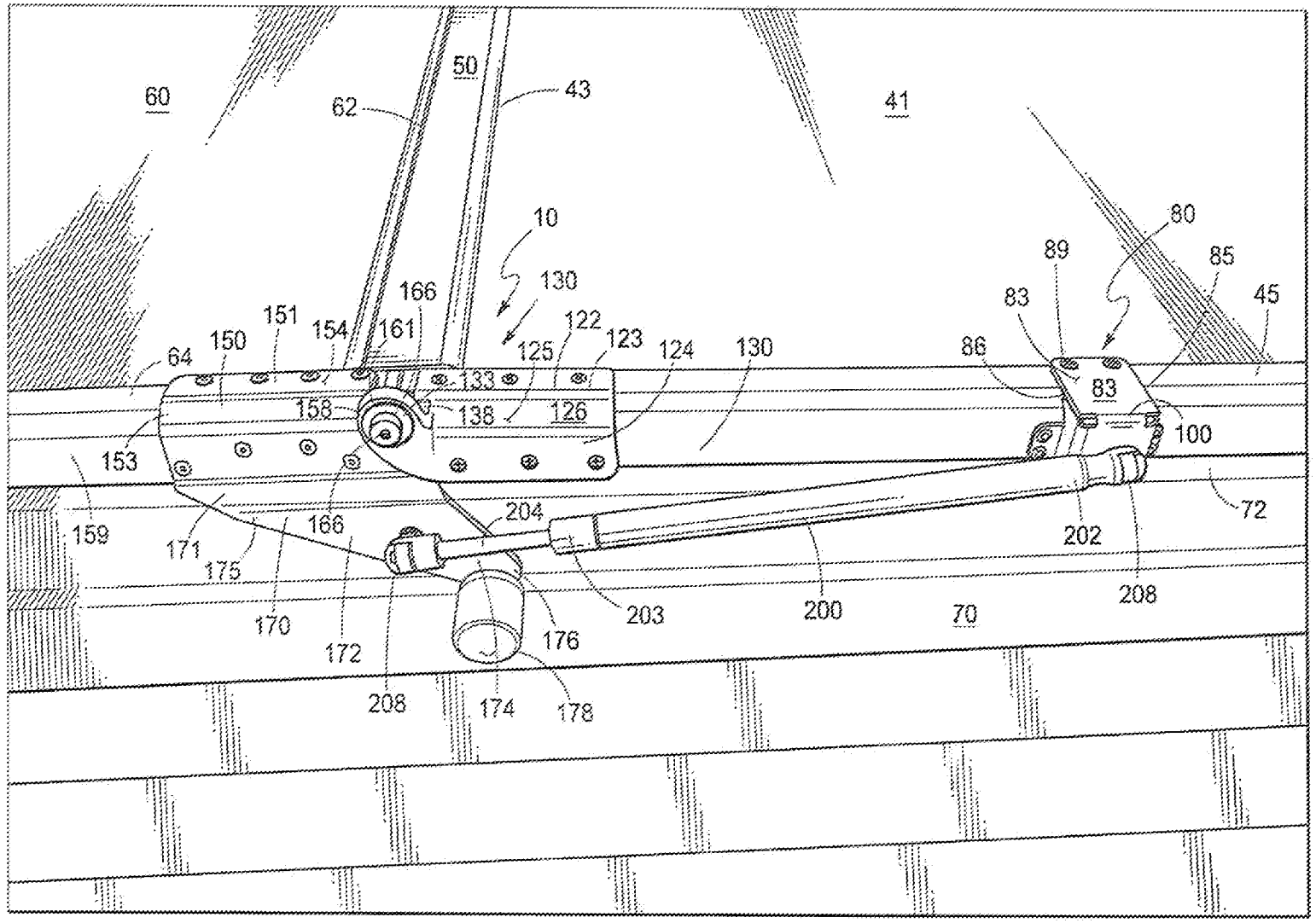

A handle 178 (FIG. 5) which may be cylindrical in shape, and having a gripping surface 179 is secured to the vertical flange 172 proximate to the flange tip 176. The handle 178 provides an external gripping means for a user to assist in the pivoting of the first spa cover portion 41 relative to the second spa cover portion 60. As shown in FIG. 1, the handle 178 is offset from the pivot axle 166 and also offset from the pneumatic cylinder ball 177 toward the first hinge portion 122.

The biasing pneumatic cylinder 200 generally provides a cylinder portion 201 having a proximal end 202 and a distal end 203. The cylinder portion 201 axially carries a reciprocally movable ram portion 204 in an arrangement wherein the reciprocally movable ram portion 204 is axially enclosed within a bore (not shown) of the cylinder portion 201 when the pneumatic cylinder 200 is in a compressed/retracted state (see FIG. 1), and wherein the reciprocally movable ram portion 204 is axially partially extended from the bore (not shown) of the cylinder portion 201 when the pneumatic cylinder 200 is in an extended position. (see FIG. 7 when the first cover portion 41 is oriented vertically relative to the second cover portion 61). The pneumatic cylinder 200 is internally pressurized with a compressed gas, such that the reciprocally movable ram portion 201 is biased to the extended position.

The cylinder portion 201 carries a pneumatic cylinder socket 208 at the proximal end 202 for engagement with the pneumatic cylinder ball 99 carried by the first bracket 80. Similarly, a distal end 205 of the reciprocally movable ram portion 204 carries a similar pneumatic cylinder socket 208 for engagement with the pneumatic cylinder ball 177 carried by the ball mount arm 170 of the second hinge portion 150. The interconnection of the pneumatic cylinder 200 with the pneumatic cylinder balls 99 and 177 causes the pneumatic cylinder 200 to provide mechanical advantage to a user pivoting the first spa cover portion 41 relative to the second spa cover portion 60 about the hinge 50 and the pivot axle 166 that extends simultaneously through the axle holes 137, 165 defined in the axle hub 133 of the first hinge portion 122 and the axle hub 161 of the second hinge portion 150.

Operation

The operation of the described embodiment of the present invention 10 is believed to be readily apparent, and is briefly summarized at this point. In one of its broadest aspects of the present invention relates to a movement assistance device 10 for a spa cover 40 having at least first and second spa cover portions 41 and 60, respectively, and which are hingedly 50 interconnected together, and which further substantially fully occlude a spa opening 73 when positioned in a first position adjacent to and co-planar orientation relative to each other.

As noted previously, the instant invention is intended to be installed in pairs, one invention 10 on each lateral peripheral edge of the spa cover 40.

The first spa cover portion 41 and the second spa cover portion 60 are positioned relative to one another so that the two spa cover portions 41, 60 are coplanar and the hinge peripheral edge 43 of the first portion 41 is immediately adjacent to the hinge peripheral edge 62 of the second spa cover portion 60. If the two spa cover portions 41, 60 are previously interconnected with a hinge 50, the above-described positioning of the two spa cover portions 41, 60 can be accomplished by pivoting the two spa cover portions 41, 60 into a first coplanar adjacent relationship. (The orientation for substantially fully occluding/covering a spa). (See FIG. 8).

The first bracket 80 is fixedly mounted to the first lateral peripheral edge 45 of the first spa cover portion 41 a predetermined distance 209 from the hinge peripheral edge 43. Fasteners 103 extending through the plurality of fastener holes 89 fixedly secure the first bracket 80 to the first lateral peripheral edge 45. Because of the configuration of the side flanges 95, 96, the exterior facing surface 101 of the vertically extending leg 90 is laterally offset outwardly from the first lateral peripheral edge 45. The pneumatic cylinder ball 99 extends generally perpendicularly laterally outwardly from the exterior facing surface 101.

The first hinge portion 122 of the hinge bracket 120 is positioned adjacent the first lateral peripheral edge 45 of the first spa cover portion 41 and is aligned so that the axle hole 137 defined in the axle hub 133 is axially aligned with the hinge peripheral edge 43 of the first spa cover portion 41. Fasteners are extended through the fastener holes 132 defined in the horizontally extending top portion 123 and the vertically extending side portion 124 to fixedly secure the first hinge portion 122 to the first spa cover portion 41.

The second hinge portion 150 is positioned adjacent the first lateral peripheral edge 64 of the second spa cover portion 60 and is aligned so that the axle hole (not shown) defined in the axle hub 161 is axially aligned with the hinge peripheral edge 62 of the second spa cover portion 60. Fasteners are extended through the fastener holes 160 defined in the horizontally extending top portion 151 and the vertically extending side portion 152 to fixedly secure the second hinge portion 150 to the second spa cover portion 60.

The pivot axle 166 is inserted into the axle hole 137 defined by axle hub 133 of the first hinge portion 122 and simultaneously extended through the axle hole (not shown) defined in the axle hub 161 of the second hinge portion 150 so that the laterally inner surface (not shown) of the axle hub 133 is immediately adjacent the laterally outer surface 156 of the second axle hub 161 and the first hinge portion 122 and the second hinge portion 150 are pivotally movable relative to one another along with the interconnected first spa portion cover 41 and second spa portion cover 60. The installation process is repeated on the opposing second side of the spa cover portions 41, 60.

The first spa portion cover 41 is pivoted about the pivot axle 166 so that the end peripheral edge 44 thereof is moved generally upwardly to a position where the first spa cover portion 41 is generally vertically perpendicular relative to the second spa cover portion 60. (See FIG. 7). At this position, the two pneumatic cylinder balls 99, 177 are spaced apart from one another the greatest distance. At this position, the pneumatic cylinder 200 is installed by first "snapping" or interconnecting the pneumatic cylinder socket 208 carried at the proximal end 202 of the cylinder portion 201 into the pneumatic cylinder ball 99 carried by the first bracket 80. The pneumatic cylinder socket 208 carried by the distal end 205 of the reciprocally movable ram portion 204 is likewise "snapped" or interconnected onto the pneumatic cylinder ball 177 carried by the ball mount arm 170 of the second hinge portion 150.

Pivoting the first spa cover portion 41 relative to the second spa cover portion 60 about the pivot axle 166, and on the hinge 50, either toward the first coplanar position, or toward the second "stacked" position causes the pneumatic cylinder 200 and the ram portion 205 to compress (forcing the ram portion 204 axially into the bore (not shown) of the cylinder portion 201) which provides mechanical advantage and control to the user pivoting the spa cover 40. The pneumatic cylinder 200 assists in lifting the first spa cover portion 41 from the first coplanar position, making the "lifting" much easier and less strenuous for a user. Once the first spa cover portion 41 reaches a perpendicular position, relative to the second spa cover portion 60 (see FIG. 7), the pneumatic cylinder 200 again begins compressing as the reciprocally movable ram portion 204 is forced axially inwardly into the cylinder portion 201 causing a "controlled descent" of the first spa cover portion 41 on to the top of the second spa cover portion 60 and into the second "stacked" position. Similarly, when the first spa cover portion 41 is to be pivoted out of the second "stacked" position and moved toward the first coplanar position, the initial movement of the first spa cover portion 41 relative to the second spa cover portion 60 about the pivot axle 166 is mechanically assisted by the pneumatic cylinder 200 which eases/facilitates movement of the first spa cover portion 41 relative to the second spa cover portion 60. Again, once the first spa cover portion 41 reaches a position that is generally perpendicularly vertical relative to the second spa cover portion, the reciprocally movable ram portion 204 is again forced axially inwardly into the cylinder portion 201 causing a "controlled dissent" of the first spa cover portion 41 to a position coplanar and adjacent the second spa cover portion 60 and effectively closing the spa.

Still further the present invention includes movement assistance device for a spa cover having two spa cover portions, and wherein the two spa cover portions are movable one relative to the other between a first position, wherein the two spa cover portions are adjacent and coplanar to one another, and a second position, wherein a first of the two spa cover portions is stacked on top of a second of the two spa cover portions, the movement assistance device comprising: a hinge bracket having a first hinge portion and a second hinge portion, the first hinge portion is interconnected to a first lateral peripheral edge of the first spa cover portion adjacent a hinge peripheral edge of the first spa cover portion, the first hinge portion having an axle hub defining an axle hole that is axially aligned with the hinge peripheral edge of the first spa cover portion, and the second hinge portion is interconnected to a first lateral peripheral edge of the second spa cover portion adjacent a hinge peripheral edge, the second hinge portion having an axle hub defining an axle hole that is axially aligned with the hinge peripheral edge of the second spa cover portion, and the second hinge portion carries a pneumatic cylinder ball that extends laterally outwardly from the second hinge portion, and a pivot axle extending simultaneously through the axle hole defined in the first hinge portion axle hub and the axle hole defined in the second hinge portion axle hub; a pneumatic cylinder ball carried by, and extending laterally outwardly from, the first lateral peripheral edge of the first spa cover portion, and spaced apart from the first hinge portion, and the pneumatic cylinder ball is coplanar with the pneumatic cylinder ball carried by the second hinge portion; and a biasing pneumatic cylinder having one end portion interconnected with the pneumatic cylinder ball carried by the first spa cover portion and having a second end portion interconnected with the pneumatic cylinder ball carried by the second hinge portion.

Still further the present invention includes a movement assistance device for a spa cover, and further comprising a first bracket secured to the first lateral peripheral edge of the first spa cover portion, the first bracket carrying the pneumatic cylinder ball.

Still further the present invention includes a movement assistance device for a spa cover and further comprising a first bracket secured to the first lateral peripheral edge of the first spa cover portion, the first bracket having a horizontally extending leg, and a vertically extending leg, and the vertically extending leg carries the pneumatic cylinder ball.

Still further the present invention includes a movement assistance device for a spa cover and further comprising a ball mount arm carried by the second hinge portion at a bottom edge portion thereof, and the ball mount arm carries the pneumatic cylinder ball.

Still further the present invention includes a movement assistance device for a spa cover wherein, the first spa cover portion, when the first spa cover portion is in the second position, is inverted relative to the second spa cover portion.

Still further, the present invention includes a movement assistance device for a spa cover wherein the pneumatic cylinder ball carried by the ball mount arm carried by the second hinge portion is vertically aligned with the axle hole defined in the axle hub of the second hinge portion.

Still further the present invention includes a movement assistance device for a spa cover having a first spa cover portion and a second spa cover portion, each of the first and second spa cover portions having opposing spaced apart lateral peripheral edges, a hinge peripheral edge and an end peripheral edge, and wherein the first and second spa cover portions are movable, one relative to the other, between a first position wherein the first and second spa cover portions are adjacent and coplanar to one another and wherein the hinge peripheral edge of the first spa cover portion is immediately adjacent the hinge peripheral edge of the second spa cover portion, and a second position wherein the first spa cover portion is pivoted about its hinge edge so as to be inverted and stacked on top of the second spa cover portion, the movement assistance device comprising: a first bracket secured to a first lateral peripheral edge of the first spa cover portion spacedly between the hinge peripheral edge and the end peripheral edge, the first bracket having a horizontally extending leg and an interconnected vertically extending leg, and the vertically extending leg carries a pneumatic cylinder ball extending outwardly from the vertically extending leg; a hinge bracket having a first hinge portion and a second hinge portion, the first hinge portion has an axle hub defining an axle hole and the first hinge portion is interconnected to the first lateral peripheral edge of the first spa cover portion adjacent the hinge peripheral edge of the first spa cover portion so that the axle hole defined in the axle hub is aligned with the hinge peripheral edge of the first spa cover portion, and the second hinge portion has an axle hub defining an axle hole, and the second hinge portion is interconnected to a first lateral peripheral edge of the second spa cover portion adjacent a hinge peripheral edge of a second spa cover portion, so that the axle hole defined in the axle hub is aligned with the hinge peripheral edge of the second spa cover portion, and the second hinge portion further has a ball mount arm that carries a pneumatic cylinder ball, and the pneumatic cylinder ball is coplanar with the pneumatic cylinder ball carried by the first bracket, and a pivot axle extending simultaneously through the axle hole defined in the first hinge portion axle hub and the axle hole defined in the second hinge portion axle hub to pivotally interconnect the first hinge portion to the second hinge portion; and a pneumatic cylinder that is interconnected with both the pneumatic cylinder ball carried by the first bracket and the pneumatic cylinder ball carried by the pneumatic cylinder ball mount of the second hinge portion.

Still further the present invention includes a movement assistance device for a spa cover wherein the horizontally extending leg and the vertically extending leg of the first bracket each have a forward edge, a rearward edge, an exterior surface, an interior surface and side flanges carried by the forward and rearward edges of the vertically extending leg communicate with the horizontally extending leg to provide rigidity to the first bracket and to offset the vertically extending leg laterally outwardly from the first lateral peripheral edge of the first spa cover portion, and the first bracket defines plural spacedly arrayed fastener holes for fasteners to interconnect the first bracket to the first lateral peripheral edge of the first spa cover portion.

Still further the present invention includes a movement assistance device for a spa cover wherein, the first hinge portion of the hinge bracket has a horizontally extending top portion and a vertically extending side portion, a hinge edge and an end edge, and the axle hub is adjacent the hinge edge, and the first hinge portion further defines plural spacedly arrayed fastener holes for fasteners to secure the first hinge portion to the first lateral peripheral edge of the first spa cover portion.

Still further the present invention includes a movement assistance device for a spa cover wherein, the second hinge portion of the hinge bracket has a horizontally extending top portion, a vertically extending side portion, a hinge edge adjacent the axle hub, an end edge, and the ball mount arm; and the second hinge portion defines plural spacedly arrayed fastener holes in the horizontally extending top portion and the vertically extending side portion for fasteners to secure the second hinge portion to the first lateral peripheral edge of the second spa cover portion; and the ball mount arm extends downwardly, outwardly, and toward the hinge edge of the second hinge portion.

Still further the present invention includes a movement assistance device for a spa cover and further comprising a handle extending laterally outwardly from the second hinge portion.

Still further the present invention includes a movement assistance device for a spa cover and further comprising, a handle extending laterally outwardly from an outwardly facing surface of the ball mount arm, spacedly adjacent the pneumatic cylinder ball.

Still further the present invention includes a movement assistance device for a spa cover wherein the pneumatic cylinder cooperates with both the first and second portions of the spa cover through the first bracket and through the hinge bracket to assist in the movement of the first spa cover portion between a first position wherein the first spa cover portion is adjacent and coplanar relative to the second spa cover portion, and in which first position the spa cover portions generally fully occlude a spa opening, to a second position wherein the first and second spa cover portions are located in a partially occluding position relative to the spa opening, and wherein the pneumatic cylinder further assists in the return of the first spa cover portion back to the adjacent and coplanar orientation relative to the second spa cover portion which fully occludes the spa opening.

Even still further the present invention includes a movement assistance device for a spa cover having at least two spa cover portions, each spa cover portion having opposing lateral peripheral edges and opposing hinge and end peripheral edges, and wherein the at least two spa cover portions are movable relative to one another and relative to a spa, between a first position wherein the at least two spa cover portions are adjacent and coplanar to one another and wherein the hinge peripheral edge of a first spa cover portion is immediately adjacent the hinge peripheral edge portion of the second spa cover portion, and a second position wherein one spa cover portion is pivoted about the adjacent hinge edge portions so as to be inverted and stacked on top of the second spa cover portion, the movement assistance device comprising, a first bracket secured to a first lateral peripheral edge of the first spa cover portion spacedly between the hinge peripheral edge and the end peripheral edge, the first bracket having a horizontally extending leg and a vertically extending leg each leg having a forward edge, a rearward edge, an exterior surface, an interior surface and a side flange carried by the forward and rearward edges of the vertically extending leg communicate with the horizontally extending leg to provide rigidity to the first bracket and to offset the vertically extending leg laterally outwardly from the first lateral peripheral edge of the first spa cover portion, the first bracket further defining a plurality of spacedly arrayed fastener holes for fasteners to interconnect the first bracket to the first lateral peripheral edge of the first spa cover portion, and the vertically extending leg carries a pneumatic cylinder ball extending generally perpendicularly outwardly from the exterior surface of the vertically extending leg; a hinge bracket having a first hinge portion and a second hinge portion, the first hinge portion having a horizontally extending top portion, a vertically extending side portion, a hinge edge, an end edge and an axle hub adjacent the hinge edge, the first hinge portion further defining a plurality of spacedly arrayed fastener holes for fasteners to secure the first hinge portion to the first lateral peripheral edge of the first spa cover portion adjacent the hinge peripheral edge of the first spa cover portion so that an axle hole defined in the axle hub is generally axially aligned with the hinge peripheral edge of the first spa cover portion, and the second hinge portion has a horizontally extending top portion, a vertically extending side portion, a hinge edge adjacent an axle hub, an end edge, and a ball mount arm, and the second hinge portion defines a plurality of spacedly arrayed fastener holes in the horizontally extending top portion and the vertically extending side portion for fasteners to secure the second hinge portion to a first lateral peripheral edge of the second spa cover portion adjacent the hinge peripheral edge of a second spa cover portion so that an axle hole defined in the axle hub is generally axially aligned with the hinge peripheral edge of the second spa cover portion, and the ball mount arm is structurally interconnected to a bottom edge portion of the vertically extending portion of the second hinge portion opposite the horizontally extending top portion and the ball mount arm extends downwardly, horizontally outwardly, and toward the hinge edge of the second hinge portion, the ball mount arm carrying a perpendicularly outwardly extending pneumatic cylinder ball and a handle on an outwardly facing surface and the outwardly facing surface is coplanar with the outwardly facing surface of the first bracket, and a pivot axle extending simultaneously through the axle hole defined in the first hinge portion axle hub and defined in the second hinge portion axle hub so as to interconnect the first hinge portion axle hub to the second hinge portion axle hub so that the first hinge portion is pivotally movable relative to the second hinge portion; and a pneumatic cylinder which extends between and is pivotally interconnected with the pneumatic cylinder ball carried by the first bracket and the pneumatic cylinder ball carried by the ball mount arm of the hinge bracket second hinge portion and the pneumatic cylinder mechanically cooperates with both portions of the spa cover through the first bracket and the hinge bracket to assist in the movement of the first spa cover portion from a first position coplanar orientation relative to the second spa cover portion, which occludes a spa opening, to a second position wherein the first and second spa cover portions are located in a partially occluding position relative to the spa opening, and wherein the pneumatic cylinder further assists in the return of the first spa cover portion back to the coplanar orientation relative to the second spa cover portion which occludes the spa opening.

Therefore, it will be seen that the present invention 10 provides a convenient means whereby a user, with the exertion of minimal physical force or energy may open a spa cover 40 in an easy and simple (EAS) manner not possible, heretofore. The present invention 10 is rather simple in its construction, controls the movement of the portions of the spa cover 41 and 60, and further prevents the spa cover portions from moving in an uncontrollable fashion so as to avoid damage to either the spa or spa cover, or harm to the user. The present invention further inhibits a user from struggling to open either a large spa cover, or one that might be covered with snow or ice. As should be understood, the present invention could further include selectively actuatable air cylinders which would be used in place of the pneumatic cylinders as previously described. In this alternative embodiment (not shown) a small air compressor would be selectively coupled to the respective air cylinders, and an electric controller would selectively control the delivery of the compressed air to the respective air cylinders in a controlled manner so as to effect the opening and closing of the spa cover 40.

In compliance with the statute the invention has been described in language more or less specific as to structural and methodical features. It is to be understood, however, that the invention is not limited to the specific features shown or described since the means herein disclose comprised preferred forms of putting the invention into effect. The invention is therefore claim in any of its forms or modifications, within the proper scope of the appended claims, appropriately interpreted in accordance with the doctrine of equivalence.

I claim:

1. A movement assistance device for a spa cover having two spa cover portions, and wherein the two spa cover portions are movable one relative to the other between a first position, wherein the two spa cover portions are adjacent and coplanar to one another, and a second position, wherein a first of the two spa cover portions is stacked on top of a second of the two spa cover portions, the movement assistance device comprising:

a hinge bracket having a first hinge portion and a second hinge portion, the first hinge portion is interconnected to a first lateral peripheral edge of the first spa cover portion adjacent a hinge peripheral edge of the first spa cover portion, the first hinge portion having an axle hub defining an axle hole that is axially aligned with the hinge peripheral edge, and the second hinge portion is interconnected to a first lateral peripheral edge of the second spa cover portion adjacent a hinge peripheral edge, the second hinge portion having an axle hub defining an axle hole that is axially aligned with the hinge peripheral edge of the second spa cover portion, and the second hinge portion carries a pneumatic cylinder ball that extends laterally outwardly from the second hinge portion, and a pivot axle extending simultaneously through the axle hole defined in the first hinge portion axle hub and the axle hole defined in the second hinge portion axle hub;

a pneumatic cylinder ball carried by, and extending laterally outwardly from, the first lateral peripheral edge of the first spa cover portion, and spaced apart from the first hinge portion, and the pneumatic cylinder ball is coplanar with the pneumatic cylinder ball carried by the second hinge portion; and a biasing pneumatic cylinder having one end portion interconnected with the pneumatic cylinder ball carried by the first spa cover portion and having a second end portion interconnected with the pneumatic cylinder ball carried by the second hinge portion.

2. The movement assistance device for a spa cover of claim 1, and further comprising:

a first bracket secured to the first lateral peripheral edge of the first spa cover portion, the first bracket carrying the pneumatic cylinder ball.

3. The movement assistance device for a spa cover of claim 1, and further comprising:

a first bracket secured to the first lateral peripheral edge of the first spa cover portion, the first bracket having a horizontally extending leg, and a vertically extending leg, and the vertically extending leg carries the pneumatic cylinder ball.

4. The movement assistance device for a spa cover of claim 1, and further comprising:

a ball mount arm carried by the second hinge portion at a bottom edge portion thereof, and the ball mount arm carries the pneumatic cylinder ball.

5. The movement assistance device for a spa cover of claim 1, and wherein the pneumatic cylinder ball carried by the ball mount arm carried by the second hinge portion is vertically aligned with the axle hole defined in the axle hub of the second hinge portion.

6. The movement assistance device for a spa cover of claim 1, and wherein, the first spa cover portion, when the first spa cover portion is in the second position, is inverted relative to the second spa cover portion.

7. A movement assistance device for a spa cover having a first spa cover portion and a second spa cover portion, each of the first and second spa cover portions having opposing spaced apart lateral peripheral edges, a hinge peripheral edge and an end peripheral edge, and wherein the first and second spa cover portions are movable, one relative to the other, between a first position wherein the first and second spa cover portions are adjacent and coplanar to one another and wherein the hinge peripheral edge of the first spa cover portion is immediately adjacent the hinge peripheral edge of the second spa cover portion, and a second position wherein the first spa cover portion is pivoted about its hinge edge so as to be inverted and stacked on top of the second spa cover portion, the movement assistance device comprising:

a first bracket secured to a first lateral peripheral edge of the first spa cover portion spacedly between the hinge peripheral edge and the end peripheral edge, the first bracket having a horizontally extending leg and an interconnected vertically extending leg, and the vertically extending leg carries a pneumatic cylinder ball extending outwardly from the vertically extending leg;

a hinge bracket having a first hinge portion and a second hinge portion, the first hinge portion has an axle hub defining an axle hole and the first hinge portion is interconnected to the first lateral peripheral edge of the first spa cover portion adjacent the hinge peripheral edge of the first spa cover portion so that the axle hole defined in the axle hub is aligned with the hinge peripheral edge of the first spa cover portion, and the second hinge portion has an axle hub defining an axle hole, and the second hinge portion is interconnected to a first lateral peripheral edge of the second spa cover portion adjacent a hinge peripheral edge of a second spa cover portion, so that the axle hole defined in the axle hub is aligned with the hinge peripheral edge of the second spa cover portion, and the second hinge portion further has a ball mount arm that carries a pneumatic cylinder ball, and the pneumatic cylinder ball is coplanar with the pneumatic cylinder ball carried by the first bracket, and a pivot axle extending simultaneously through the axle hole defined in the first hinge portion axle hub and the axle hole defined in the second hinge portion axle hub to pivotally interconnect the first hinge portion to the second hinge portion; and a pneumatic cylinder that is interconnected with both the pneumatic cylinder ball carried by the first bracket and the pneumatic cylinder ball carried by the pneumatic cylinder ball mount of the second hinge portion.

8. The movement assistance device for a spa cover of claim 7 and wherein the horizontally extending leg and the vertically extending leg of the first bracket each have a forward edge, a rearward edge, an exterior surface, an interior surface and side flanges carried by the forward and rearward edges of the vertically extending leg communicate with the horizontally extending leg to provide rigidity to the first bracket and to offset the vertically extending leg laterally outwardly from the first lateral peripheral edge of the first spa cover portion;

the first bracket defines plural spacedly arrayed fastener holes for fasteners to interconnect the first bracket to the first lateral peripheral edge of the first spa cover portion.

9. The movement assistance device for a spa cover of claim 7 and wherein, the first hinge portion of the hinge bracket has a horizontally extending portion and a vertically extending side portion, a hinge edge and an end edge, and the first hinge portion further defines plural spacedly arrayed fastener holes for fasteners to secure the first hinge portion to the first lateral peripheral edge of the first spa cover portion.

10. The movement assistance device for a spa cover of claim 7 and wherein, the second hinge portion of the hinge bracket has a horizontally extending top portion, a vertically extending side portion, a hinge edge adjacent the axle hub, an end edge, and the ball mount arm; and the second hinge portion defines plural spacedly arrayed fastener holes in the horizontally extending portion and the vertically extending portion for fasteners to secure the second hinge portion to the first lateral peripheral edge of the second spa cover portion; and the pneumatic cylinder ball mount extends downwardly, outwardly, and toward the hinge edge of the second hinge portion.

11. The movement assistance device for a spa cover of claim 7 and further comprising:

a handle carried by the second hinge portion.

12. The movement assistance device for a spa cover of claim 10 and further comprising:

a handle extending laterally outwardly from an outwardly facing surface of the pneumatic cylinder ball mount, spacedly adjacent the pneumatic ball.

13. The movement assistance device for a spa cover of claim 7 and wherein the pneumatic cylinder cooperates with both the first and second portions of the spa cover through the first bracket and through the hinge bracket to assist in the movement of the first spa cover portion between a first position, wherein the first spa cover portion is adjacent to and coplanar relative to the second spa cover portion, and while in the first position the spa cover portions generally fully occlude a spa opening, and a second position wherein the first and second spa cover portions are positioned in a partially occluding position relative to the spa opening, and wherein the pneumatic cylinder further assists in the return of the first spa cover portion back to the adjacent and coplanar orientation relative to the second spa cover portion which fully occludes the spa opening.

14. A movement assistance device for a spa cover having at least two spa cover portions, each spa cover portion having opposing lateral peripheral edges and opposing hinge and end peripheral edges, and wherein the at least two spa cover portions are movable relative to one another and relative to a spa, between a first position, wherein the at least two spa cover portions are adjacent and coplanar to one another and wherein the hinge peripheral edge of a first spa cover portion is immediately adjacent the hinge peripheral edge portion of the second spa cover portion, and a second position, wherein one spa cover portion is pivoted about the adjacent hinge edge portions so as to be inverted and stacked on top of the second spa cover portion, the movement assistance device comprising:

a first bracket secured to a first lateral peripheral edge of the first spa cover portion spacedly between the hinge peripheral edge and the end peripheral edge, the first bracket having a horizontally extending leg and a vertically extending leg, each leg having a forward edge, a rearward edge, an exterior surface, an interior surface, and a side flange carried by the forward and rearward edges of the vertically extending leg communicate with the horizontally extending leg to provide rigidity to the first bracket, and to offset the vertically extending leg laterally outwardly from the first lateral peripheral edge of the first spa cover portion, the first bracket further defining a plurality of spacedly arrayed fastener holes for fasteners to interconnect the first bracket to the first lateral peripheral edge of the first spa cover portion, and the vertically extending leg carries a pneumatic cylinder ball extending generally perpendicularly outwardly from the exterior surface of the vertically extending leg;

a hinge bracket having a first hinge portion and a second hinge portion, the first hinge portion having a horizontally extending portion, a vertically extending portion, a hinge edge and an end edge and an axle hub proximate the hinge edge, the first hinge portion further defining a plurality of spacedly arrayed fastener holes for fasteners to secure the first hinge portion to the first lateral peripheral edge of the first spa cover portion adjacent the hinge peripheral edge of the first spa cover portion so that an axle hole defined in the axle hub is axially aligned with the hinge peripheral edge of the first spa cover portion, and the second hinge portion has a horizontally extending portion, a vertically extending portion, a hinge edge carrying an axle hub, an end edge, and a pneumatic cylinder mount, and the second hinge portion defines a plurality of spacedly arrayed fastener holes in the horizontally extending portion and the vertically extending portion for fasteners to secure the second hinge portion to a first lateral peripheral edge of the second spa cover portion adjacent the hinge peripheral edge of a second spa cover portion so that an axle hole defined in the axle hub is axially aligned with the hinge peripheral edge of the second spa cover portion, and the ball mount arm is structurally interconnected to a bottom edge portion of the second hinge portion vertically extending portion opposite the horizontally extending portion and the ball mount arm extends downwardly, horizontally outwardly, and toward the hinge edge, and, the ball mount arm carries a perpendicularly outwardly extending pneumatic cylinder ball and a handle on an outwardly facing surface, and the outwardly facing surface is coplanar with the outwardly facing surface of the first bracket, and a pivot axle extending simultaneously through the axle hole defined in the first hinge portion axle hub and defined in the second hinge portion axle hub to interconnect the first hinge portion axle hub to the second hinge portion axle hub so that the first hinge portion is pivotally movable relative to the second hinge portion; and a pneumatic cylinder which extends between, and is pivotally interconnected with, the pneumatic cylinder ball carried by the first bracket and the pneumatic cylinder ball carried by the ball mount arm of the hinge bracket second hinge portion, and the pneumatic cylinder mechanically cooperates with both portions of the spa cover through the first bracket and through the hinge bracket to assist in the movement of the first spa cover portion from a first position coplanar orientation relative to the second spa cover portion, which occludes a spa opening, to a second position wherein the first and second spa cover portions are located in a partially occluding position relative to the spa opening, and wherein the pneumatic cylinder further assists in the return of the first spa cover portion back to the coplanar orientation relative to the second spa cover portion which occludes the spa opening.

15. The movement assistance device for a spa cover of claim 14 and wherein the pneumatic cylinder ball carried by the ball mount arm of the second hinge portion is vertically aligned with the axle hub of the hinge portion.

16. The movement assistance device for a spa cover of claim 14 and wherein the handle carried by the ball mount arm is offset from the axle hole defined in the axle hub toward the end peripheral edge of the first spa cover portion.

* * * * *